US011193324B2

(12) United States Patent
Matthews

(10) Patent No.: US 11,193,324 B2
(45) Date of Patent: Dec. 7, 2021

(54) INSULATING GLASS SPACER CONSTRUCTION

(71) Applicant: ALLMETAL Inc., Itasca, IL (US)

(72) Inventor: Gary R. Matthews, Des Plaines, IL (US)

(73) Assignee: ALLMETAL Inc., Itasca, IL (US)

( * ) Notice: Subject to any disclaimer, the term of this patent is extended or adjusted under 35 U.S.C. 154(b) by 608 days.

(21) Appl. No.: 16/076,398

(22) PCT Filed: Mar. 8, 2018

(86) PCT No.: PCT/US2018/021589
§ 371 (c)(1),
(2) Date: Aug. 8, 2018

(87) PCT Pub. No.: WO2018/165457
PCT Pub. Date: Sep. 13, 2018

(65) Prior Publication Data

US 2021/0180396 A1 Jun. 17, 2021

Related U.S. Application Data

(60) Provisional application No. 62/469,721, filed on Mar. 10, 2017.

(51) Int. Cl.
*E06B 3/66* (2006.01)
*E06B 3/67* (2006.01)
(Continued)

(52) U.S. Cl.
CPC ..... *E06B 3/67313* (2013.01); *E06B 3/66314* (2013.01); *E06B 3/66361* (2013.01);
(Continued)

(58) Field of Classification Search
CPC .. E06B 3/663; E06B 3/66314; E06B 3/66361; E06B 3/67313; E06B 3/67317; E06B 2003/6638; E06B 2003/66385
See application file for complete search history.

(56) References Cited

U.S. PATENT DOCUMENTS 4,261,145 A 4/1981 Brocking
4,627,263 A 12/1986 Bayer et al.
(Continued)

FOREIGN PATENT DOCUMENTS

CN 1944312 A 4/2007
CN 107023246 A * 8/2017
(Continued)

OTHER PUBLICATIONS

Dec. 19, 2019—(CA) Notice of Allowance—Appln No. 3,012,935.
(Continued)

*Primary Examiner* — Ryan D Kwiecinski
(74) *Attorney, Agent, or Firm* — Banner & Witcoff, Ltd.

(57) ABSTRACT

A spacer construction for insulating glass for windows comprised of thin sheets of metal, such as stainless steel, formed with a first bottom side panel wherein the first bottom side panel joins first and second spaced, typically diverging, lateral side walls or panels. A second inside wall of the spacer assembly is spaced from the bottom side of the first section or channel and joins, typically by welding, to the lateral side walls of the first section thereby forming a tube or chamber into which desiccant may be placed. A cushion material layer is positioned over and on the bottom side panel and is covered by a polymeric sheet affixed or bonded to the lateral sides to form an internal chamber filled with desiccant. The desiccant is positioned to impact against the film or sheet bonded to the bottom side panel and at least a portion of the lateral side walls of the channel enabling the
(Continued)

assembly to effectively accommodate bending forces and stress upon bending of the spacer.

17 Claims, 8 Drawing Sheets

(51) Int. Cl.
*E06B 3/673* (2006.01)
*E06B 3/663* (2006.01)

(52) U.S. Cl.
CPC ..... *E06B 2003/6638* (2013.01); *E06B 2003/66385* (2013.01)

(56) References Cited

U.S. PATENT DOCUMENTS 4,720,950 A 1/1988 Bayer et al.
4,850,175 A * 7/1989 Berdan ..... E06B 3/6604 52/786.13
4,912,837 A 4/1990 Bayer
4,945,614 A 8/1990 Kasai
5,094,055 A * 3/1992 Berdan ..... E06B 3/66314 428/34
5,161,401 A 11/1992 Lisec
5,377,473 A * 1/1995 Narayan ..... E06B 3/66314 52/172
5,461,840 A * 10/1995 Taylor ..... E06B 3/66314 52/786.13
5,512,341 A * 4/1996 Newby ..... E06B 3/66314 428/35.8
5,568,714 A * 10/1996 Peterson ..... E06B 3/66323 52/172
5,705,010 A 1/1998 Larsen
6,023,656 A 2/2000 Cacas et al.
6,023,956 A 2/2000 Bayer
6,737,129 B2 5/2004 Bayer
6,823,644 B1 * 11/2004 Peterson ..... E06B 3/66314 52/172
7,891,155 B2 * 2/2011 Surowiecki ..... E04C 3/07 52/842
10,132,114 B2 * 11/2018 Siodla ..... E06B 3/66319
10,487,569 B2 * 11/2019 Nea ..... B32B 19/02
10,550,628 B2 * 2/2020 Runze ..... E06B 3/221
10,633,914 B2 * 4/2020 Runze ..... E06B 3/66319
10,648,223 B2 * 5/2020 Graham ..... E06B 3/67343
10,649,252 B2 * 5/2020 DeMiglio ..... C03C 17/23
10,920,480 B2 * 2/2021 McGlinchy ..... E06B 3/67313
2004/0079047 A1 * 4/2004 Peterson ..... E06B 3/66323 52/786.13
2008/0053037 A1 * 3/2008 Gallagher ..... E06B 3/66314 52/786.13
2014/0165484 A1 6/2014 Zurn et al.
2019/0071919 A1 * 3/2019 McGlinchy ..... E06B 3/67313
2021/0071466 A1 * 3/2021 Nusser ..... E06B 3/66342

FOREIGN PATENT DOCUMENTS

CN 110388169 A * 10/2019
DE 3246988 A1 6/1984
EP 0054251 A1 6/1982
EP 0318748 A2 6/1989
EP 2463472 A1 * 6/2012 ..... E06B 3/66314
EP 3643869 A1 * 4/2020 ..... E06B 3/66314
WO WO-9319274 A1 * 9/1993 ..... E06B 3/66314
WO 9706332 A2 2/1997
WO WO-2012085123 A1 * 6/2012 ..... E06B 3/66333

OTHER PUBLICATIONS

Jan. 2, 2020—(CN) Notice of Allowance—Appln No. 201880001096.X.
Jun. 3, 2019—(CA) Examiner's Report—App 3012935.
Aug. 1, 2019—(CN) First Office Action—App 201880001096.X—Eng Tran.
International Search Report and Written Opinion for PCT/US2018/021589 dated May 3, 2018.
Nov. 1, 2019—(EP) Notice of Allowance—Appln No. 18711803.9.

* cited by examiner

INSULATING GLASS SPACER CONSTRUCTION

CROSS REFERENCE TO RELATED APPLICATIONS

The present application is a U.S. National Phase filing of International Application No. PCT/US18/21589, filed on Mar. 8, 2018, designating the United Stated of America and claiming priority to U.S. Appl. Ser. No. 62/469,721 filed Mar. 10, 2017, and this application claims priority to and the benefit of both the above-identified applications, which are incorporated by reference herein in the entireties.

TECHNICAL FIELD

In a principal aspect the invention relates to insulating glass (IG) window and door constructions and, more particularly, window constructions comprised of spaced glass panes that are separated by a spacer to form a chamber between the panes filled with an inert gas such as Argon.

BACKGROUND OF THE INVENTION

Insulated glass panel assemblies are commonly specified for windows and other openings in buildings. The insulated glass panels are typically comprised of panes of glass separated by spacers positioned along the periphery of the panes to thereby define an internal chamber between the panes which is filled with an inert gas. The peripheral spacer is typically in the form of a hollow tube made from thin sheet metal, such as stainless steel. The tube or spacer is sealed against the opposed, spaced panes to form the chamber for retention of an inert gas. The tubes are typically hollow and filled with a desiccant to preclude formation of condensed moisture in the chamber between the panes.

The spacer tubes are typically made from two or more die formed thin metal sheets that are welded together to form an elongate tube which is then shaped to conform with the periphery of the spaced glass panes.

Various patents have issued relating to the construction of insulated glass assemblies including the following which are incorporated herewith by reference:

| Pat. No. | Inventor(s) | Title | Issue Date |
|---|---|---|---|
| 4,627,263 | Bayer et al. | Method of and Apparatus for Making Spacers for Use in Multiple-Pane Windows or the Like | Dec. 9, 1986 |
| 4,912,837 | Bayer | Method of and Apparatus for Making Spacer Frames for use in Multiple-Pane Windows | Apr. 3, 1990 |
| 4,720,950 | Bayer et al. | Spacers for use in Multiple-Pane Windows or the Like | Jan. 26, 1988 |
| 4,945,614 | Kasai | Buckle Assembly | Aug. 7, 1990 |
| 6,023,956 | Bayer | Device for Bending a Hollow Section with a Hold Down Clamp | Feb. 15, 2000 |
| 6,737,129 B2 | Bayer | Insulating Glass Pane with Individual Plates and a Spacer Profile | May 18, 2004 |
| 4,261,145 | Bröcking | Spacer for Double-Pane and Multiple-Pane Windows and Method and Apparatus for Making Same | Apr. 14, 1981 |
| 5,705,010 | Larsen | Multiple Pane Insulating Glass Unit with Insulative Spacer | Jan. 6, 1998 |
| 5,161,401 | Lisec | Apparatus for Producing Bent Sections in Hollow Profile Strips | Nov. 10, 1992 |

An important aspect or feature of such insulating glass assemblies is the integrity of the peripheral spacer tubes. Typically manufacture of the spacers or tubes involves manufacture of straight, elongate tubular members that are then filled with desiccant. The elongate tubes are subsequently bent at selected positions to conform with the configuration of the boundary or periphery of separated glass panes bonded to the opposite sides of the formed tube or spacer.

During the spacer or tube manufacturing process, bending of the tubes may cause undesired distortions, micro-cracks, metal folds, and punctures or holes in the tube material. Failure or weakness in the structure of the insulated glass assembly may result. Such issues may be exacerbated by the shape and construction of the spacer tube. Spacer tubes typically include multiple component parts. Also the metal sheets generally include groves or troughs that extend longitudinally in the direction of the longitudinal axis of the tube or transverse to that axis. The spacer tubes may thus comprise a channel shaped section having a complex cross section shape that forms the base and sides of the tube and a flat thin metal plate forming a fourth side or top panel of the tubular member. The channel section may thus include a bottom wall, spaced lateral side walls, transverse walls extending from the side walls and sections adapted to receive support and be joined to a metal plate welded to the channel to form a straight elongate spacer tube. As a consequence, there are multiple configurations and cross sectional shapes of elongate spacer tubes which may or may not perform in a satisfactory manner.

Bending of such tubes to form corners may result in failure of the tubes. Thus, the design of straight, elongate tubes which can be efficiently manufactured yet safely bent to form corners presents a significant challenge. Such problems may be exacerbated by incorporation of grooves and other design features in the tubes which affect their strength, heat conductivity, aesthetics, processing, manufacturing rates, and ease of incorporating in combination with spaced glass panes.

Such issues may be further exacerbated by the materials utilized as a desiccant. A typical desiccant, for example, is termed a "molecular sieve" and comprises material having a bead like appearance and shape. The beads may be inconsistent in size, shape and hardness. They may crack and provide sharp edge sides or projections. The condition of such beads during bending of spacers may be impacted adversely by the design of the tube. For example, tubes having elongate axial troughs formed therein on various surfaces and filled with certain desiccants may fail or fracture when bent. During a bending operation, wherein desiccant is maintained in the hollow interior of a spacer tube, may puncture or fracture or distort the spacer troughs or otherwise cause a change in the shape of the spacer making it inefficient to provide an adequate seal between the separate panes associated with the window assembly. The desiccant may also adversely affect the flatness of certain surfaces of the spacer thereby distorting or undercutting the capability of the spacer to provide an appropriate seal or structural integrity of the IG pane, as a rigid, composite assembly.

The equipment which is utilized to effect bends may also adversely affect the process of providing a consistent bend shape. The combination of the shape of the walls forming the spacer tube and the desiccant retained therein may promote tube or spacer failure.

Various types of bending operations have been utilized to make such spacers. For example, if a compression bending operation is adopted, the straight, elongate spacer tubes are typically not totally filled with desiccant before bending. If a compression bender is utilized and the tube is filled with desiccant, the bottom surface of the spacer profile may be distorted into the top surface causing contact between the two surfaces. This creates a double thickness of thermally conductive material and adversely impacts the heat transmission efficiency of the spacer.

Another type of bending is a draw bending process which may require that the straight, elongate spacer tube be filled with desiccant. In draw bending the bend is formed by mechanically gripping the spacer and effectively pulling the spacer around a mandrel or similar rigid form. However, often the desiccant within the spacer, may distort or break through the spacer tube wall.

Nonetheless, draw type benders are typically used for bending thin, high tensile strength metal materials due to their ability to avoid buckling or collapse of the spacer sealing surfaces. Such draw-type benders typically rely on totally pre-filling the spacer tubes with desiccant prior to bending. In this manner, the desiccant becomes a readily available internal mandrel for the desired bends at any position along the length of the spacer tube. However, the bending process is not completely predictable since many variables can have an adverse effect on the bend quality, for example, by bending to cause the tube walls to thin beyond design limits or fail catastrophically. Thus many variables are involved with a bending process including all of the material properties of the spacer components as well as the bending device mechanics and dynamics.

Other factors may affect spacer manufacture. For example, increased production speeds and reduced material costs narrow the tolerance bands of each of the variables discussed above.

Thus, the present invention seeks to enable increased tolerances of the factors discussed during a bend cycle to allow increased opportunity for material reductions and/or increased production rates.

The use of internal particulates for the purpose of smooth bending of tubing is another object and aspect of the invention.

Inclusion of desiccant in the form of molecular sieve incorporated in window spacers is a further object and aspect of the invention.

Molecular sieve desiccant material is typically a porous ceramic, generally spherical bead, sized in the 0.5 to 2 mm diameter range. Of all the components involved with the bending process, sieve or desiccant material most often have the largest degree of variability. Molecular sieve comes with variable spherocity, surface roughness, hardness, bead size tolerances that may exceed 15% variations, not taking into account partially formed or broken beads or the dust that is present with each tube fill of a tube with desiccant. The bending process requires that the desiccant move in three dimensional space while the tube walls are being stretched over it.

All of the aforesaid aspects of (IG) assemblies thus present extremely complex manufacturing and spacer design issues and an object of the invention is to provide improved spacer designs which address or resolve the recited factors among others.

SUMMARY OF THE INVENTION

Briefly the present invention comprises a spacer construction for insulated glass (IG) windows. The spacer comprises an assembly of component parts including a first channel having an open top. The channel is formed from a thin metal material, such as stainless steel, and is assembled in combination with a second, connecting top or upper panel or plate which is spaced from a bottom wall of the channel. The upper panel is typically welded to spaced side walls of the first channel to form a straight, elongate tube with an internal chamber. The elongate tube first channel comprises a generally planar or shaped bottom wall or bottom side which may include a series of elongate or shaped troughs typically extending in the axial or longitudinal direction of the tube or spacer. The troughs may, however, have any of a multiple variety of configurations including a transverse pattern in the bottom side or wall. The troughs include a compressible filler material, such as silicone or an equivalent, having a durometer or hardness which permits flexure, but maintains integrity to effect transmission of compressive forces on the desiccant material. Additionally, a structural film layer, such as a polymeric sheet or equivalent is fitted over the bottom panel and filler material and is adhered to and fitted against the inside surface of the lateral side walls. The sheet or film is typically and generally in contact with the filler material on the inside surface of the bottom panel or wall thereby covering or encapsulating the compressible material, e.g. silicone, filling the troughs in the bottom wall or panel. The film is thus affixed to the lateral sides of the first channel or section of the spacer assembly in a manner which enables the film to accommodate stress on the film from desiccant resident over the film in the interior of the internal spacer chamber between the film and a plate or wall forming the top of the spacer or tube opposite or opposed to the bottom wall of the spacer or tube. The desiccant material may thus engage or impinge on the film as a result of bending of the desiccant filled spacer tube regardless of the bending mechanism utilized to bend the spacer tube.

The spacer tube chamber thus includes or is filled with desiccant retained in the chamber defined by the walls of the first channel and the top cover plate which together form an elongate desiccant chamber. The film is fitted over the bottom inside surface of the channel and over at least a portion of the spaced side walls diverging or extending upwardly from a location over the bottom panel, plate or surface. The sheet or film thus may be compressed against the flexible material residing between the film and bottom wall of the spacer.

The cross section of the spacer assembly may be varied. The attached film, which is fitted against or in opposition to the inside face of the bottom panel or plate, is stretched or placed under stress due to a bending operation of an elongate spacer tube to form a corner of the spacer tube. The film and trough design accommodate stress on the bottom side of the spacer due to bending of the spacer to form a corner. The combination of the layer of film on the interior of the spacer chamber fitted over the bottom side and troughs against a layer of a compressible material, such as silicone, effectively accommodates or "manages" the stress due to bending of the spacer walls. The result of the described combination substantially precludes stress cracks and weakening of the walls of the spacer tube.

Thus, it is an object of the invention to provide an improved spacer construction for insulated glass (IG) pane assemblies.

A further object of the invention is to provide a spacer construction comprised of a thin sheet or thin sheets of metal, such as stainless steel, formed with a first bottom side panel wherein the first bottom side panel joins first and second spaced, typically diverging, lateral side walls or panels. A second or integral or top wall of the spacer assembly is spaced from the bottom side of the first or bottom wall. For example, a top wall is joined typically by welding, to the lateral side walls of the first channel section thereby forming a tube or chamber into which desiccant may be placed. The desiccant is positioned to impact against a film or sheet bonded to the bottom side panel and at least a portion of the spaced lateral side walls of the first channel section of the spacer.

It is a further object and feature of the invention to provide a spacer assembly for an insulated glass window construction which provides improved structural integrity to the insulated glass (IG) construction comprised of glass panes and a spacer.

Another object of the invention is to provide a spacer construction which may include corners formed by a compression bending operation, a draw bending operation as well as other manufacturing techniques.

Yet another object of the invention is to provide a spacer tube assembly which is reasonably priced, and capable of being manufactured using various manufacturing techniques.

Another object of the invention is to provide a spacer tube assembly for insulated glass panels which enables higher production rates of insulated glass panels.

A further object of the invention is to provide a spacer assembly which precludes development of fractures, cracks, breaks or weakened sections in the exterior walls of spacer assemblies.

Another object of the invention is to provide a spacer assembly which alternates vibration and dissipates sound in an insulated glass panel assembly.

Another object of the invention is to provide a spacer assembly which enables utilization of reduced thickness of metal and other materials that comprise a tubular form of a spacer assembly.

These and other objects, advantages, aspects and features of the invention are to be set forth in the detailed description as follows.

BRIEF DESCRIPTION OF THE DRAWINGS

In the detailed description as follows reference will be made to the drawing comprised of the following figures.

DESCRIPTION OF AN EMBODIMENT OF THE INVENTION

Figure 1:
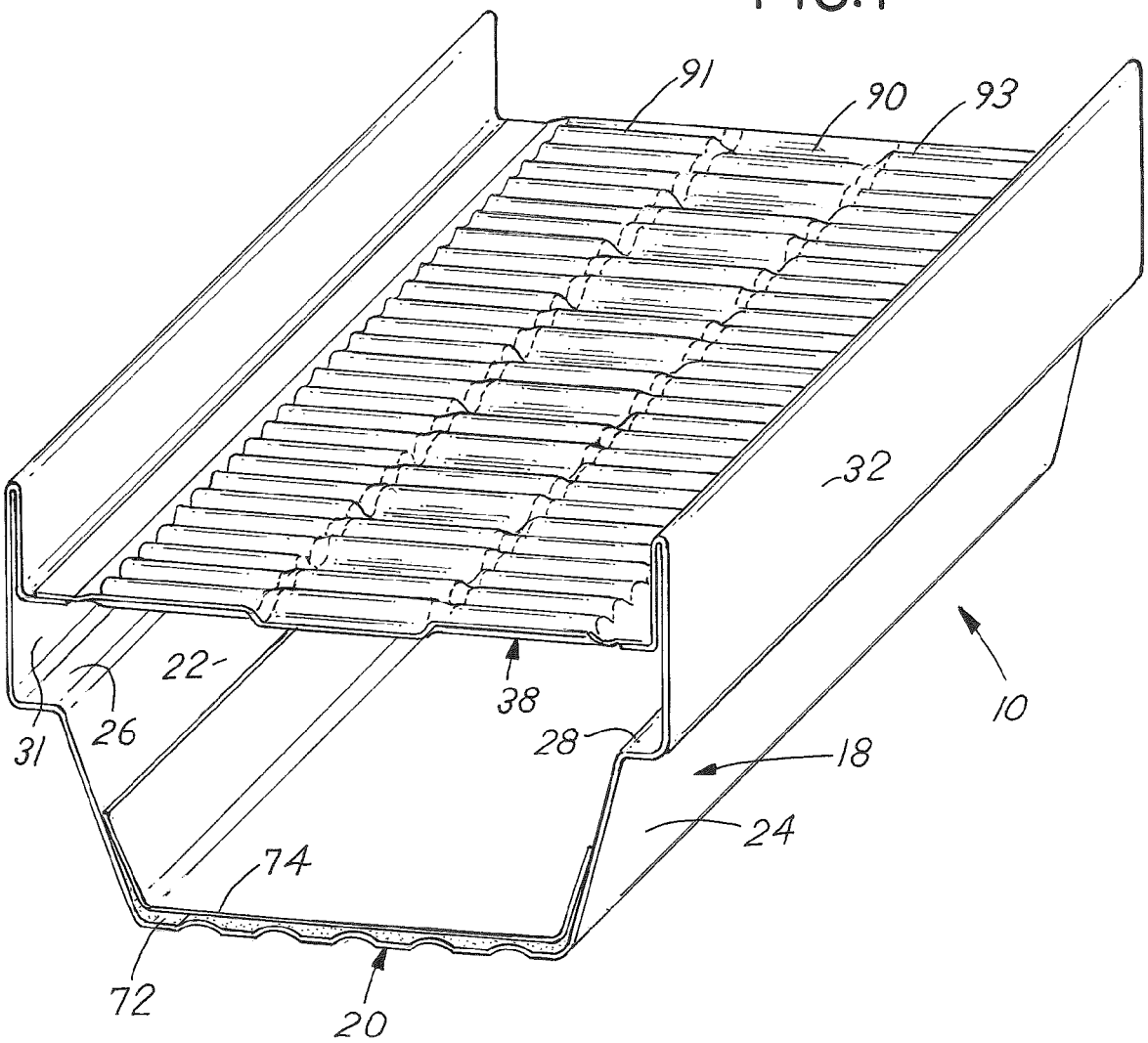
FIG. 1 is an isometric view of an embodiment of a spacer tube of the invention.

FIG. 1 is an isometric view of an embodiment of the invention. A spacer 10 is comprised of a generally U cross section shaped channel 18, a top panel or plate 38, a cushion layer 72 covering the bottom 20 of channel 18 and a sheet of film 74 covering the cushion layer 72. Desiccant material 80 fills the internal chamber 60 formed by the sheet 74, side walls 22, 24 and top plate 38.

Figure 3:
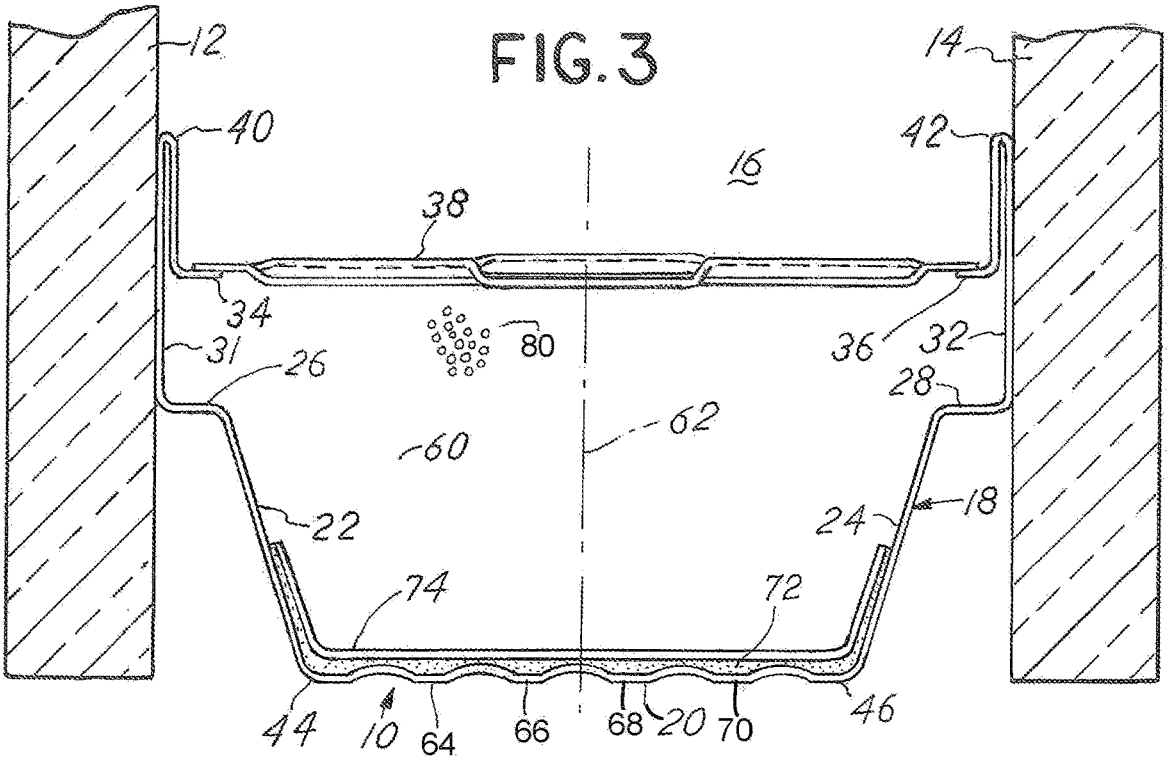
FIG. 3 is a cross sectional view of the spacer tube embodiment of FIG. 1 in combination with spaced glass panes.
Figure 4:
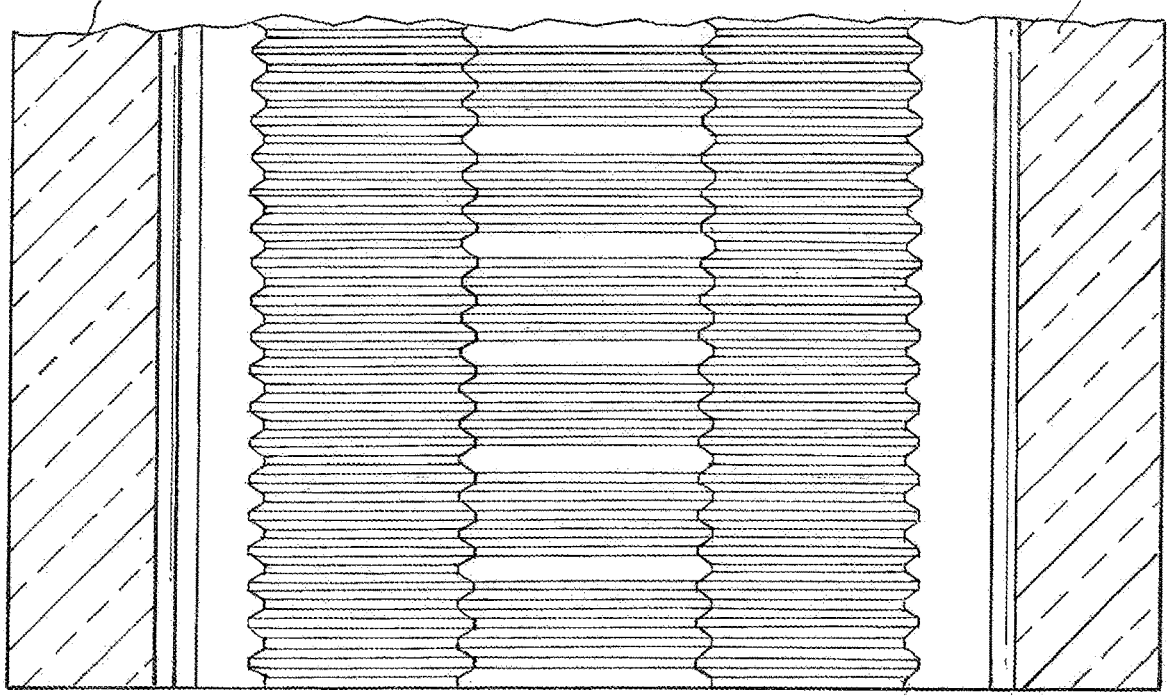
FIG. 4 is a top plan view of the spacer assembly of FIG. 2.
Figure 5:
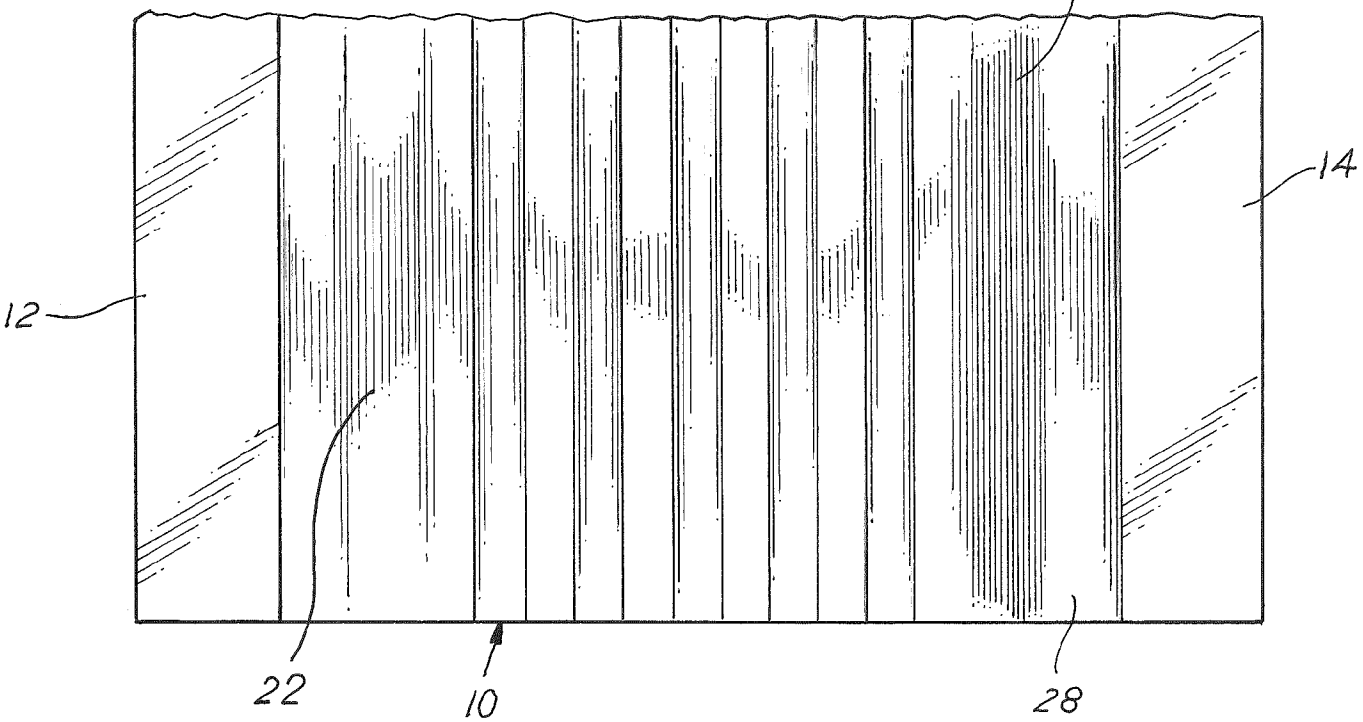
FIG. 5 is a bottom plan view of the spacer assembly of FIG. 2.
Figure 6:
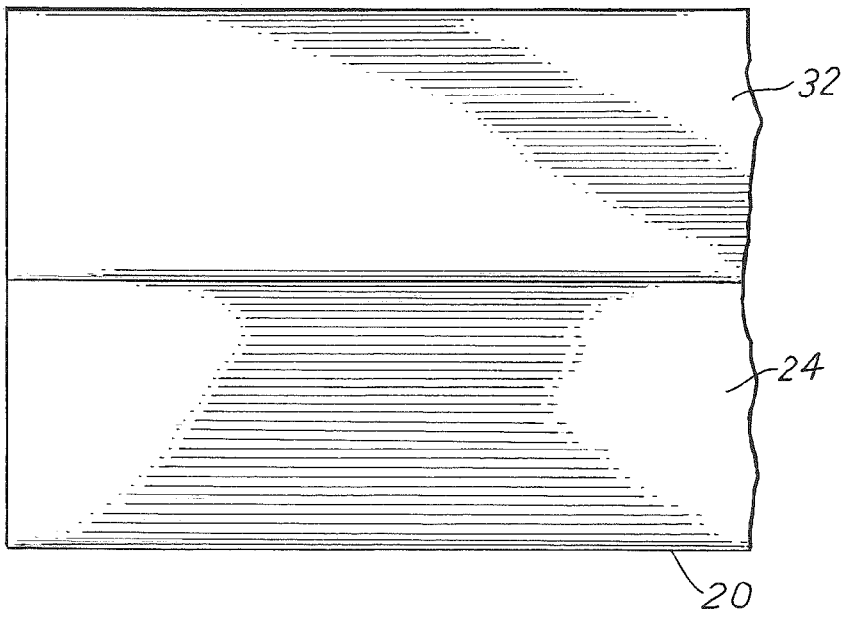
FIG. 6 is a lateral side view of the spacer assembly wall of FIG. 2 as viewed from the right hand side of FIG. 1.

FIG. 3 illustrates the tube or spacer construction 10 in combination with a first window pane 12 and a second window pane 14 to comprise an insulated glass (IG) window assembly. The spacer 10 provides a means for joinder of and maintaining the first and second panels 12, 14 in alignment, spaced one from the other, in order to provide an IG assembly with spacer chamber 16 which is generally airtight and capable of receiving and retaining an inert gas such as argon. The glass panels or panes 12 and 14 are thus separated one from the other and each glass pane 12, 14 is adhered or bonded to the spacer 10 as described hereinafter.

Figure 2:
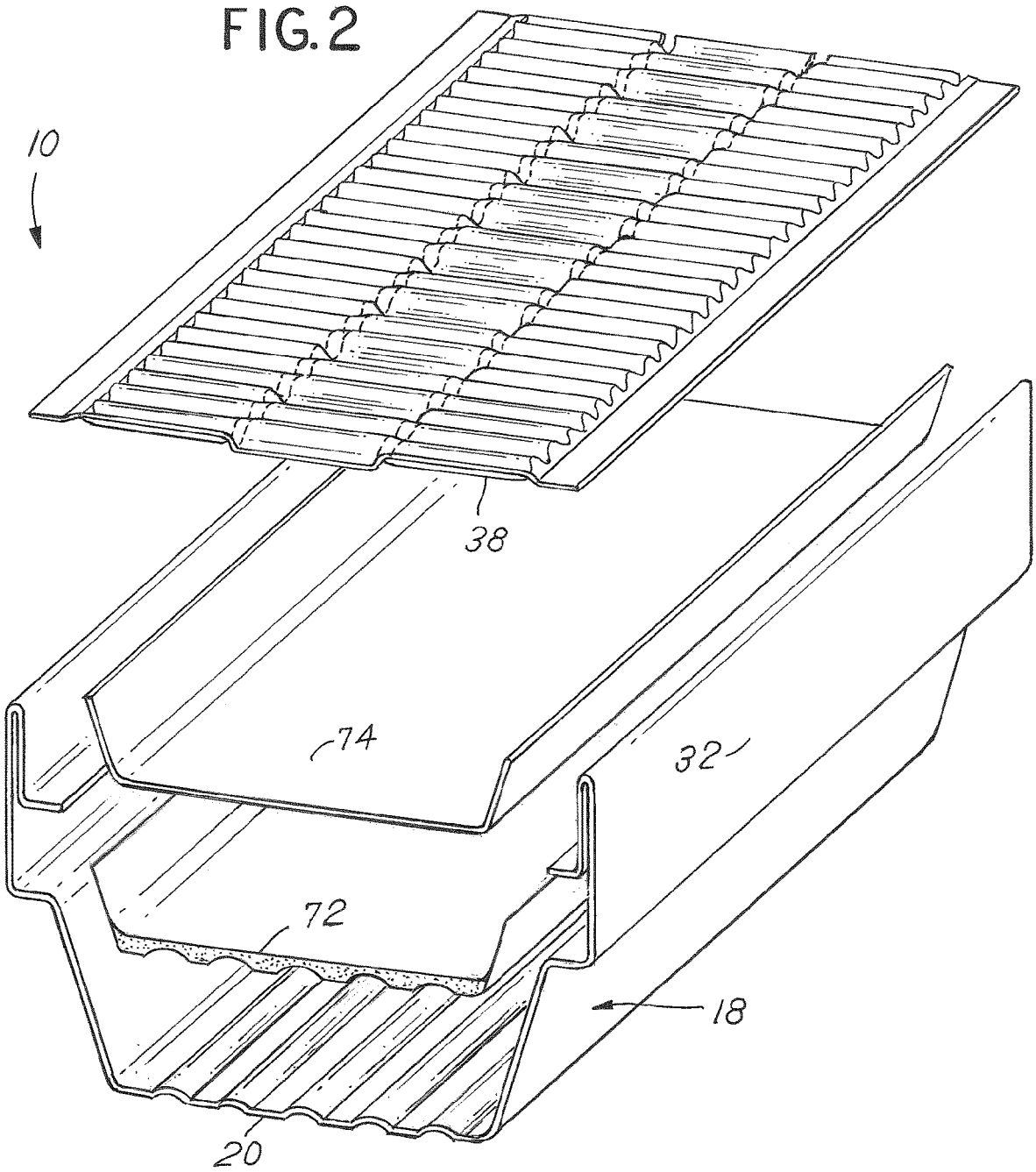
FIG. 2 is an exploded isometric view of the spacer tube of FIG. 1 depicting the component parts forming the tube including the metal form with the bottom wall, the compressible pushing material fitting in the troughs along the bottom wall, the stress receiving film connecting the side walls and overlying the bottom wall and cushion thereon.

The spacer 10 is thus in the form of an elongate tube which is bent into the shape of a frame which generally conforms with the periphery of the first and second window pane panels 12 and 14. Thus, rectangular glass panels 12, 14 may be combined with a tube or spacer 10, having a structure as depicted in FIGS. 1 and 2 which is bent or formed in the shape of a frame including four spaced corners, for example, located between elongate straight sections.

In the embodiment depicted, the spacer 10 is comprised of a top panel or plate 38 combined with a thin sheet metal generally U-shaped cross section channel 18. Channel 18 includes a generally planar bottom side or panel 20 joined with first and second lateral side walls or panels 22 and 24 which, in the embodiment depicted, diverge uniformly outwardly from the bottom panel 20 at an angle in the range of 10 to 30°. The upper ends of the first and second side walls 22, 24 include first and second outwardly extending, transverse runs or extensions 26 and 28 which are generally parallel to the bottom panel 20. The first and second transverse extensions 26 and 28, respectively, connect to an upwardly extending side panel section 31 and 32. The first and second side panel sections 31 and 32 are generally parallel and flat on their outside surface so that adhesive or an adhering material or compound can be placed on the outer surface of the side panels 31 and 32 to engage and seal those panels 31, 32 on the inner opposed surface of opposed glass panels 12 and 14 respectively.

The top edges 40, 42 of the first and second side panels 31 and 32 are folded downwardly and shaped to include inward extensions 34 and 36, respectively, which are generally parallel to the bottom panel 20. Extensions 34, 36 are designed to cooperatively receive and support an elongate a cover plate or panel 38 that is welded along its opposite edges 40 and 42 to the extensions 34 and 36 respectively. The plate 38 may include various patterns of troughs and/or projections 90 and recesses formed therein which, as discussed herein, accommodate the process of formation of corner bends of the spacer 10 and also provide enhanced rigidity of the spacer 10 in its final form. The spacer 10 thus includes a hollow chamber 60 defined by the plate 38 and the channel 18.

The channel 18, as well as the plate 38, are formed typically from a uniformly thick sheet of thin metal material such as stainless steel. A typical dimension of the thickness of the stock material forming the channel member 18 and the plate 38 is in the range of 0.035±0.010 inches. The side surfaces of the parallel upward extensions 31 and 32 are spaced laterally from each other in the range of about 0.50 inches though that spacing may be altered or amended depending upon the construction of the insulated glass (IG) unit. The plate 38 typically includes gas passages or openings which permit access to gases in the space between the panels 12, 14.

The configuration and orientation of channels such as the channel 18 may be varied. However, with respect to the practice of the invention, the construction depicted in the figures is considered typical and beneficial. That is, the bottom panel 20 and top plate 38 generally transverse to the panes of glass 12 and 14. Various other configurations of the channel 18, however, may be adopted in the practice of the invention.

The bottom or base panel 20 is typically configured to include an elongate, longitudinal arcuate trough 44 at the juncture of first side wall 22 and the bottom wall 20. A similar trough section 46 is formed by an arcuate bend located at the juncture between the second outwardly and upwardly extending wall 24 and the bottom panel 20. The troughs of 44 and 46 extend longitudinally generally parallel to the elongate bottom panel 20 and the generally parallel upper plate or panel 38. The troughs 44 and 46 extend longitudinally in the direction of a centerline axial plane 62 of the channel 18. The design of the channel 18 depicted in the FIGS. is such that the plane 62 is a plane of symmetry for the channel 18. The adoption of a symmetrical construction as described is not a limiting feature of the invention, however. Further, in the embodiment described, there are additional longitudinal troughs in the bottom panel 20, namely, troughs 64, 66, 68 and 70 which extend longitudinally parallel to the plane 62. The troughs are 64, 66, 68 and 70 as well as troughs 44 and 46 have substantially equal dimensions and configurations and are equally spaced from each other. However, the particular form and arrangement of troughs may be varied. Trough length, shape and patterns may be varied and distinct. The troughs may have complex shapes and lengths rather than the uniformly longitudinal forms depicted in the bottom panel 20. The troughs may include transverse portions or sections as well as sections or portions which diverge at various angles from the axial plane 62. Multiple trough patterns may be adopted depending upon the materials used, the dimensions of the materials, the size of the bends that are to be made in the spacer 10 and other factors.

The size and positioning of the troughs or grooves 44, 46, 64, 66, 68 and 70 becomes a further aspect of the invention. That is, the outer grooves 44 and 46 may be characterized by an increased radius boundary of troughs 44, 46 between the channel side walls 22, 24 that project outwardly from each other and the bottom panel 20. This radius, for example, with respect to a material having a thickness in the range 0.035 inches may at the corners joining the wall 20 to the wall 22 and the wall 20 to the wall 24 may be in the range of 0.0185 inches. Variations of these dimensions are permitted in order to achieve desired spacer 10 bending characteristics as described hereinafter.

The spacer or tube 10 further includes a compressible material 72 such as a silicone layer over and residing or residing merely within one or more of the troughs 44, 46, 64, 66, 68 and 70. Typically the troughs are each filled with a common compressible material 72 such as silicone which has a characteristic of being flexible, capable of being compressed and capable of transfer of compression forces placed thereon. The compressible material may also merely cover the top sides or surface of troughs or patterned depression on the inside of bottom wall 20. Different compressible materials 72 may be placed in different troughs or distinctly sized or shaped troughs or sections or patterns of troughs. The cushion material 72 is typically a high-solids material such as a silicone 72 which acts as a cushion and support for the additional elements incorporated in the spacer 10.

Overlying the bottom panel 20 and extending at least partially upward along the first and second outwardly extending walls 22 and 24 is a stress relieving film 74 or stress absorbing film, for example, a polymeric film material 74. The polymeric film material 74 is typically affixed to the bottom area of lateral side walls 22 and 24 or may engage sections or portions of the inside surface of the bottom panel 20 as well as being positioned in a manner over the troughs and in contact with the cushion material 72 within the troughs or covering the troughs.

Further in the disclosed embodiment, the region of the chamber 60 intermediate the film 74 end top panel is typically filled with a molecular sieve material such as a desiccant 80 or other materials having the characteristic of molecular sieve. Thus, a desiccant bead material or combination thereof optionally with one or more appropriate granular materials or appropriate granular or bead like materials may serve a function for transmission of force when bending the spacer. This material is basically a porous ceramic, generally spherical bead sized in the 0.5 to 2 mm diameter range. Molecular sieve comes with variable spherocity, surface roughness, hardness, bead size tolerances that may exceed 15% variations. Partially formed or broken beads or the dust may be present with each chamber fill. The bending process requires that the desiccant (sieve material) can move in three-dimensional space while the spacer walls are being stretched over it. The most critical surface being the top panel of the spacer tube, i.e. the bend surface with the largest radius. This surface has the most stress applied to it, due primarily to it being forced to get longer to accommodate the bender geometry. If the sieve material stops moving, it drags on the tube wall material enough to thin it causing a failure. Also, if a sharp enough bead edge is encountered, the spacer wall material yield is exceeded and a formed crack may develop The design effectively multiples the physical diametrical size of any single sieve bead into something larger and reduces the load by a square function to the spacer wall. Currently, the wall thicknesses of a spacer is chosen to provide a variety of qualities important to the finished IG panel, primarily structural strength, but in part to statistically cover expected failures resulting from production anomalies. This results in lighter weight IG panels, more tube wall thickness is being used to insure production success than is required to support the glass or to contain the desiccant or sieve material. In contrast with the disclosed design inconsistencies of the sieve material are abated.

Thus, desiccant 80, in particular a molecular sieve type desiccant, in the volume or chamber 60 is provided between the plate 38 over the film 74 that covers the bottom panel 20. Upon bending of a spacer 10, the sieve material 80 acts as a means to transmit aspects of the bending forces against the film 74. Film 74 in combination with cushion material 72 in troughs 44, 46, 64, 66, 68, 70 in turn, relieves some of the stress and strain on the panel 20 by transfer of forces associated with bending against the material in the troughs and, of course, the bottom panel 20 attenuated by the film 74 and cushion material 72. As a result, a smoothly curved spacer is fashioned in a manner and does not distort in an abnormal fashion or fracture or crack the spacer 10 or bottom panel 20. The system therefore, in essence, provides a means which provides a damping response to the bending forces applied thereto as those forces are effected by bending equipment of the type previously described. A purpose and function of the film 74 is absorption of at least some of the strain and stress associated with the bending of a spacer 10, particularly on the bottom panel 20.

Thus, the spacer construction 10 provides a construction which enables bending of thinner channel 18 and plate 38 materials more effectively and evenly or uniformly. Further, the bending at the corners of the spacers 10 can be effected more efficiently and consistently.

Figure 7:
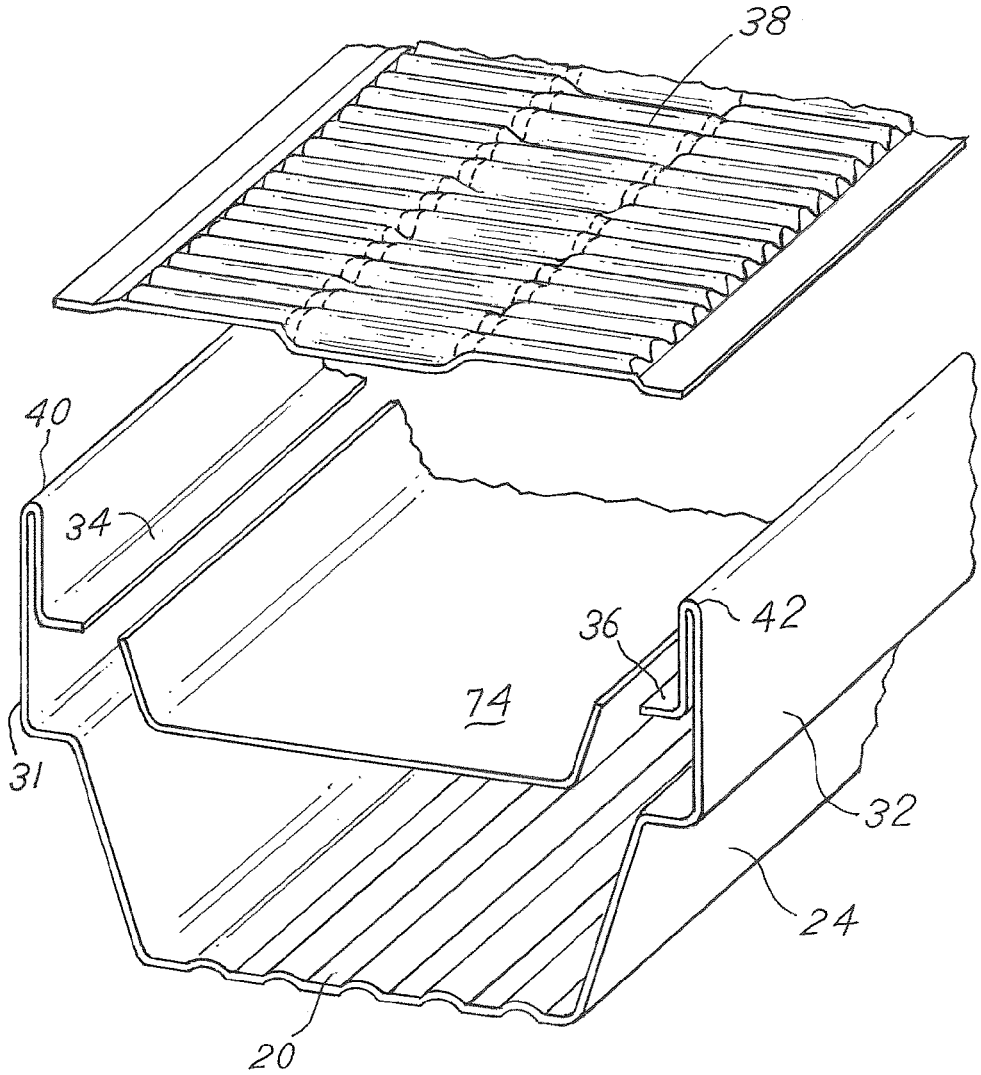
FIG. 7 is an isometric view of an alternative embodiment of the invention.
Figure 8:
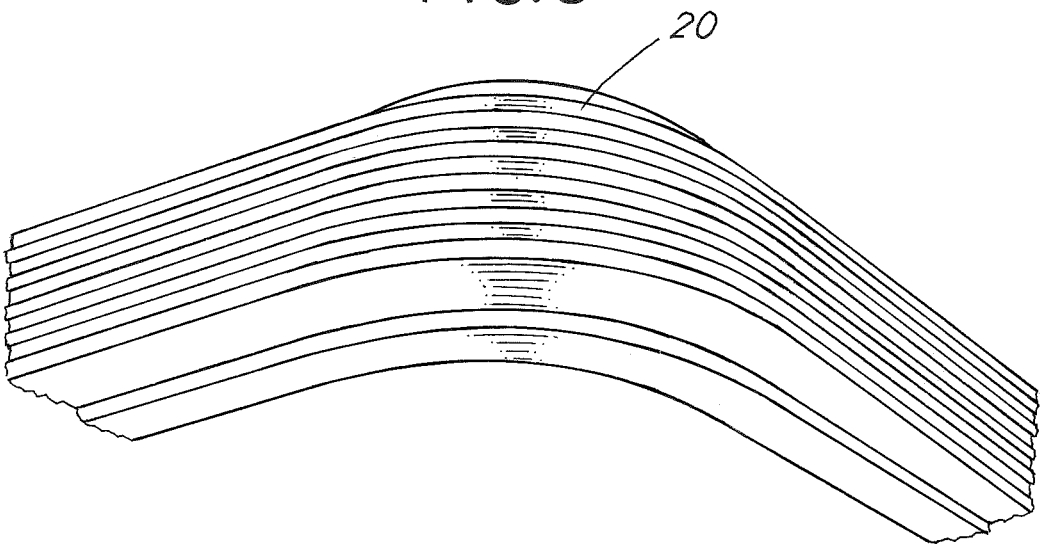
FIG. 8 is an isometric view of a spacer tube corner bend.
Figure 9:
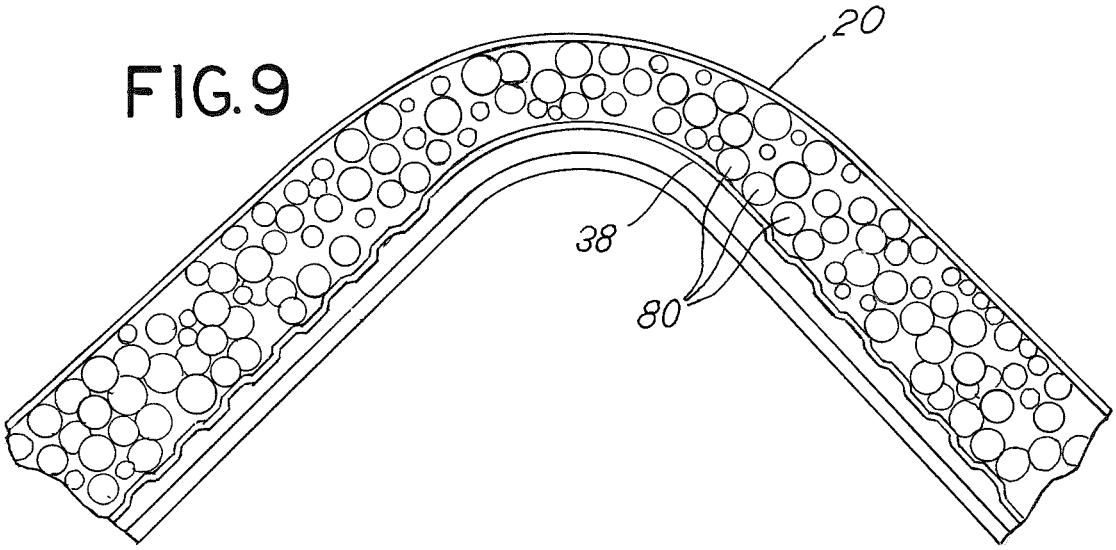
FIG. 9 is a sectional view of a corner bend of a spacer tube of FIG. 7.

FIGS. 7 and 8 illustrate in greater detail the arrangement of the component parts when they are bent to form a corner for a spacer. That is, the bottom wall 20 of the channel 18 is stretched to a certain degree as the bend occurs. Additionally, the other components of the spacer may be formed or folded as a result of the bending operation about a specific axis or radius in a manner which precludes fracture of the bottom panel 20 and the side surfaces described. Controlled distortion of the lateral or side surfaces of the spacer 10 is accomplished in a manner which maintains a flat surface for bonding against the glass panel walls of the glass panes 12, 14 that are spaced by virtue of the spacer tubes 10.

In review, to effect a corner bend, the bottom panel 20 is typically stretched about a radius and stressed. Stresses and strain of the film layer 74 provide a platform which engages against the cushioning material 72, silicone 72, by way of example, which resides over bottom panel 20 and in the troughs. Thus, upon bending and shaping the elongate spacer in a bending device of the type previously described, various bending forces are imposed on the film 74 as well as the channel cushioned material 72 attenuated with respect to the bottom panel 20.

For example, the choice of the cushioning material 72 and the appropriate application thereof in the channels along with the potential control of the curing and thus the flexibility as well as the tensile strength and hardness of the cushioning material may attenuate the stresses on the panel 20 and on the other component parts of the spacer. The fluidity of the cushioning material may also have an impact that is beneficial with respect to such a bending operation. For example, by careful placement and distribution of the cushioning material, such as a silicone, the stresses placed on the spacer as a result of a bending operation may be more adequately distributed. Further, the cushioning material such as silicone if properly chosen and proportioned may provide a sound deadening benefit and preclude transmission of vibration through the metallic spacer materials. For example, the silicone may dampen the transmission of vibrations which might otherwise be inherent in the window construction, but by including the combination of features and elements so described the transmission of vibrations may be damped and provide sound transmission characteristics that diminish undesirable noise levels due to vibration.

The component parts, namely, the channel 18 and the plate 38 have been welded together to form the cross sectional elongate spacer 10 which is then subject to further processing. Before welding the component parts 18 and 38 together, however, the troughs 44, 46, etc. are filled with the silicone or compression material 72 and the film layer 74 is inserted to the channel 18. Both activities occur prior to the welding of the plate 38 to the channel 18. As a result of the manufacture of a tubular member 10 as depicted, for example, in FIGS. 1 and 2, an elongate straight line extending spacer tube is created.

As a next step in the manufacture of the spacer 10 the chamber 60 is filled with the desiccant material 80. The resultant tube 10 is then subjected to a bending operation by one of the bending processes previously referenced. During such a bending operation or process step, a bend is formed in the elongate spacer with the result of such a bend depicted in FIG. 7. It is to be noted that the troughs in the embodiment depicted comprise elongate depressions in the wall or bottom panel 20. The bottom panel 20 is, as a result of the bending operation, stretched about a radius defined by the bending tooling. FIG. 8 illustrates a resultant bend. The desiccant 80 which has been inserted into the chamber 60 is compressed and the wall plate 38 is distorted or folded as are the upper extended walls 31, 32. Those side walls 31 and 32 are thus compressed and can be become somewhat distorted though the bending operation. The distortions can then be attenuated by virtue of the design which includes the inclusion of troughs 44, 46, 64, 66, 68 and 70 in combination with the stress relieving film 74 and the compression material 72 described above.

In practice, the bend as shown in FIG. 8 will accommodate stresses and strains more easily because the loads are distributed between the side walls 22 and 24 as well as the additional side walls 31 and 32 by virtue of the shape of the troughs, the number of the troughs, the stress bearing film 74.

These features can be maximized to provide for a spacer 10 wherein the starting materials forming the channel 18 and the plate 38 may be minimized by inclusion of the troughs as indicated as well as the material fitted into the troughs and the inclusion of the stress relieving film 74. All of these features may be enhanced by combining therewith appropriate patterns in the troughs. That is the troughs are the embodiment depicted elongate and parallel to the linear extension or axis of the spacer. However, the troughs may include lateral portions or a combination of lateral and longitudinal portions and various other patterns in order accommodate the stress associated with bending.

The inclusion of the film 74 is an important aspect, however, and it is also important that the film 74 extend the entire width of the bottom panel 20 between the side walls 22, 24 and preferably over the outer or top edges of cushion 72. Further, it is important to choose an appropriate high-solids cushion material such as silicone. Further, the plate 38 may include various patterns of troughs and stress relieving sectors or surfaces. For example, as depicted in FIG. 1 there is a median arrangement of transverse troughs 90 with planar sections 91, 93 on either side of those transverse trough sections 90. A combination of linear troughs with such transverse troughs 90 or patterns of troughs in the plate 38 may further accommodate the bending stresses in order to maintain the integrity of a bend formed in the spacer 10. An object in this regard is to insure that there is no break in the walls of the spacer and, in particular, the bottom panel or wall 20 as well as the bifurcated side walls 22 and 24 as well as the lateral walls or extensions 26 and 28. The lateral extensions 26 and 28 may be in another embodiment eliminated and the bifurcated walls 22 and 24 may extend directly into contact with the parallel outside walls 31, 32 of the channel 18.

In any event, multiple issues may arise when attempting to form a corner from a straight, elongate spacer tube 18 filled with or at least partially filled with desiccant 80. Distortion or fracture of the spacer tube 10 by the desiccant 80 is an issue that may persist.

Distortions may manifest themselves by depressions in the wall 20 resulting from imposition by beads of sieve material such as desiccant 80 occurring during a bending operation. Elimination of such distortions is thus sought to be accomplished by combinations of controlling the design and thickness of spacer walls, inclusion of a fluidic layer cushion 72 (e.g. silicone), and the inclusion of a stress relieving film 74.

As depicted in the figures the addition of a load spreader in the form of a high tensile strength film 74, used in conjunction with a relatively high durometer cushion material 72 alleviates desiccant 80 stresses and supplements the overall integrity of the spacer 10. The plastic film 74 is, for example, a Polyester or Mylar film, or a Polyamide or Kapton. Metal foils could be used as well in the capacity of the load spreader film 74, but may also provide a source of thermal transmission which normally is not desired. The cushion material 72 could be any of the sealant materials used in (IG) unit construction, including PIB, or polysulphide. High solids silicone is preferred. A Kapton-Silicone combination enables accommodation for high temperatures exceeding 500° F., making such a combination very suitable for spacer 10 post coating since such processes can utilize excess heat approaching those temperatures. Silicone's bonding abilities also come into play, as it keeps the film 74 exactly where it is desired as it is being placed into the tube 10. With regards to chemical fogging, the Kapton is inert, and the proper silicone, once cured, would also be considered inert. This construction and manufacturing method can be applied to any type of spacer 10.

The film 74 also imparts tensile strength in a linear fashion along the longitudinal axis of the spacer 10, adding additional strength in that direction to whatever features are present in the bottom of the tube 10. Both the film 74 and cushion 72 can be inserted into the tube 10 wherever roll forming of channel 18 is formed. This could be done in the flat sections of a forming process when the channel 18 profile is fully formed, but before the top plate 38 is applied. Under the right circumstances, it can be applied to a one-piece spacer design, but applying this to a two-piece design is easier, and therefore preferred.

The film 74 is typically slightly wider than the span over the bottom of the profile, but should typically not extend up the sidewalls of the channel profile by more than ⅓ of their height. The film 74 is wide enough to accommodate excess cushion material 72 by covering and retaining the cushion material 72 such that it does not adhere to tooling. Too much will interfere with bend making in the form of ripples around a curve protruding into the profile cavity, which will become a point of interference with the desiccant beads 80.

The cushion material 72 may be pre-applied to the film 74 and both inserted into the spacer tube 10 at the same time. It may also be applied to the bottom panel 20 of the spacer 10 and the film 74 applied over and onto it separately. In both cases a finishing roller or wiper may be employed to control finished height and squeeze out any air present between film 74 and cushion material 72.

Typically, an important spacer surface is the back or top 38 of the spacer 10, i.e., the bend surface with the largest radius. This surface has the most stress applied to it, due primarily to it being forced to stretch more to accommodate the bender geometry. This surface will seek to reach equilibrium with whatever material is behind it to support it while the bending mechanism is in operation. The support should thus have a large enough surface area to not exceed the ultimate stress point of the tube wall material. However, if the desiccant 80 is moving during bending, it may drag on the spacer interior walls to potentially thin a wall possibly causing a failure. If a sharp enough desiccant bead edge is encountered, the tube wall material yield is exceeded and a fully formed crack may develop. Typically, the wall thicknesses of the spacer 10 is chosen to provide a variety of qualities important to the finished insulating glass panel, primarily structural strength, but, in part, to statistically cover expected failures resulting from production anomalies. This indicates that for lighter weight panel units, more tube wall thickness is likely used to insure production success than required to support the glass or to contain the desiccant. The design of the described embodiments and equivalents accommodates the inconsistencies of the beads or desiccant, resulting in use of less metal in the tube walls.

An alternative aspect of the invention relates to the cushion layer 72 previously described. Layer 72 may be incorporated with, or encompass, aspects and features including incorporation of patterns of members or elements laminated, encapsulated, or otherwise included with or within the cushion layer 72. A previously described cushioning material (trade name Kapton) provides insulating characteristics up to 500° F. That material may, for example, be loaded with certain materials such as carbon and/or metal which would comprise circuits to carry power to provide heating of the tube 10 or the reverse process, to provide a cooling effect. Circuits could be incorporated in the cushioning layer 72 which would provide or include a means that would provide a heat sink or a heat source to either effect cooling or heating by or of the spacer walls. During the IG manufacturing process, for example, heat could be transmitted to spacer walls via circuitry embodied in the cushion layer 72 to cure adhesive to bond side walls to the glass panes abutting those walls of the IG assembly. These operations could be effected after the frame of the spacer is formed and during the manufacturing process of the insulated glass pane assembly.

Figure 10:
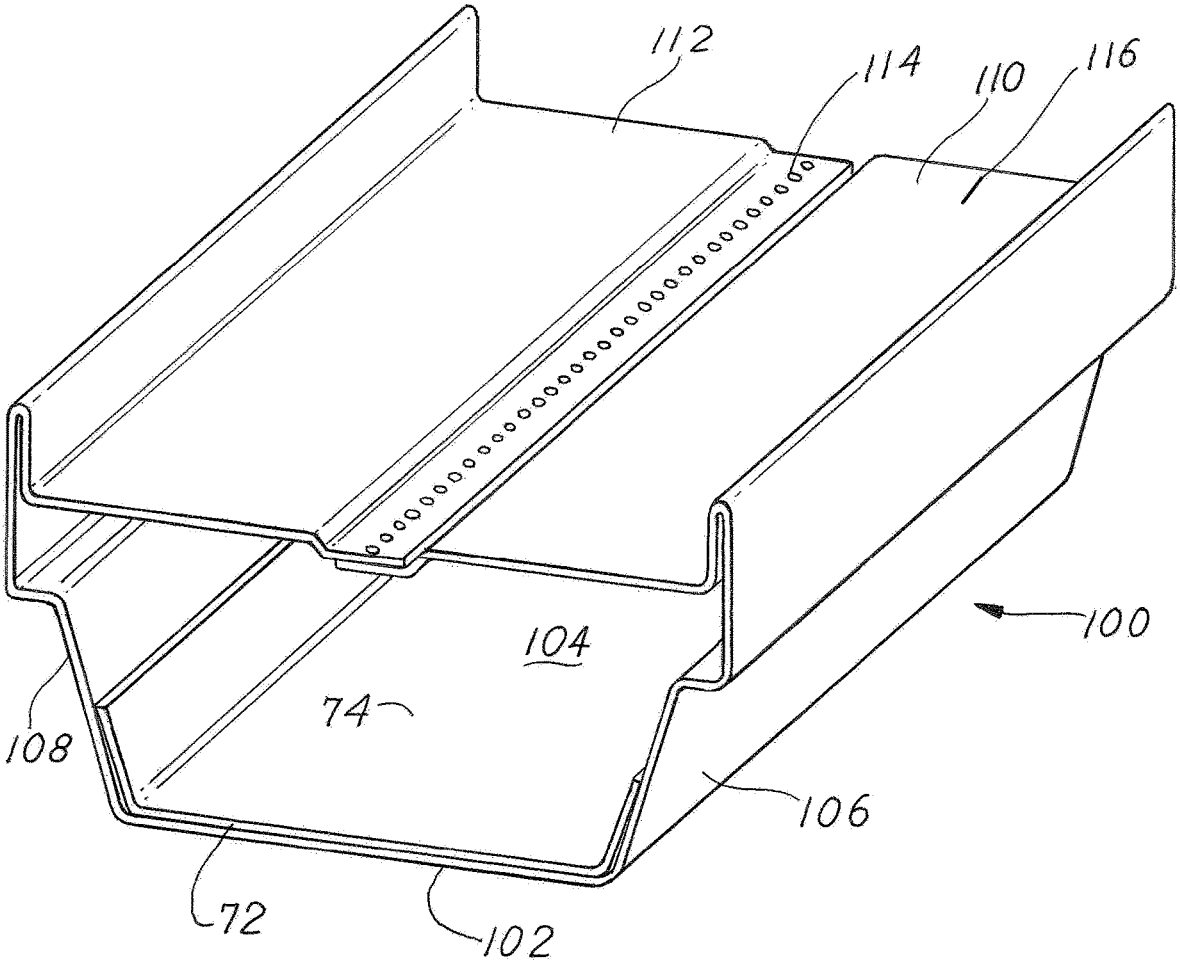
FIG. 10 is an isometric view of an alternative embodiment of the spacer assembly of the invention.

A further alternative aspect of the invention is to provide a spacer comprised of a unitary channel construction fabricated from an elongate single strip of a formed metal material or the like as depicted in FIG. 10. Thus, an elongate strip of metal such as stainless steel is formed to define a spacer 100 in combination with a layer of cushion material 72 positioned on a bottom wall 102 of the configured spacer 100. Lateral side walls 106 and 108 of the spacer chamber 104 are configured or formed in a manner quite similar to the two part or two component spacer previously described. However, the spacer 100 further includes integral laterally projecting, opposed overlapping extensions 110 and 112 which are welded together along a seam 114 to thereby serve as a top side panel 116 of the spacer 100 generally parallel to the bottom wall or side 102. The film material 74 is positioned against the cushion material 72 and is adhered to the opposite side walls 106 and 108. A desiccant material (not shown) fills the interior space 104 between the top panel 116 and the sheet 74. The embodiment can be manufactured and assembled as depicted in FIG. 10 and subsequently subjected to bending forces as previously described to form a frame which is positioned between opposed glass panes.

While various aspects, features and objects of the invention have been set forth, the invention is limited only by the following claims and equivalents thereof.

Thus, the component parts which are incorporated in a spacer in combination with an insulated glass pane assembly may include varied materials and assume various configurations to achieve the benefits and aspects of the invention and the embodiments thereof as described.

What is claimed is:

1. An insulating glass spacer construction comprising:

(a) an elongate, metallic sheet, bendable hollow form having a longitudinal axis, said hollow form including a bottom panel, a first lateral side panel joined to a first side edge intersection with the bottom panel, a second spaced lateral side panel joined to a second side edge intersection with the bottom panel, said longitudinal axis located between the first lateral side panel and the second lateral side panel, and a top panel joined to the first and second lateral side panels to provide an elongate interior chamber, said panels extending generally parallel to the longitudinal axis;

(b) a force transmission cushion material located in the chamber on said bottom panel, said cushion material positioned to transmit a force onto the bottom panel;

(c) a membrane film member generally in the form of a sheet material adhered to said first and second side panels and covering the force transmission cushion material, said film member characterized by a tensile strength capable of accommodating a tensile stress upon compression on said force transmission cushion and on said bottom panel, said side panels, said bottom panel and said film member forming a section of the elongate chamber; and (d) a sieve material in said elongate chamber intermediate the film member and the top panel.

2. The construction of claim 1 wherein the longitudinal axis is substantially equally spaced between the first and second side panels.

3. The construction of claim 1 wherein the side panels are stepped.

4. The construction of claim 3 wherein the lateral side panels are formed substantially as mirror images of each other.

5. The construction of claim 1 wherein the side panels are formed substantially as mirror images of each other.

6. The construction of claim 1 wherein the film member comprises a material selected from the group consisting of a polymeric film, a metallic sheet and a combination of a polymeric film and a metallic sheet.

7. The construction of claim 6 wherein the cushion material comprises one or more materials selected from the group consisting of silicone material, a polymeric material and a combination of silicone material and a polymeric material.

8. The construction of claim 7 wherein the spacer construction includes an arcuate bend configuration.

9. The construction of claim 1 wherein the cushion material is one or more materials selected from the group consisting of a silicone material, a polymeric material and a combination of a silicone material and a polymeric material.

10. The construction of claim 1 wherein the spacer construction includes an arcuate bend.

11. The construction of claim 1 including one or more channels in said bottom panel parallel to the longitudinal axis.

12. The construction of claim 1 including at least two longitudinal channels are formed, one of which is located along the intersection of the bottom panel and the first lateral side panel and the other of which is located along the intersection of the bottom side panel and the second lateral side panel.

13. The construction of claim 1 wherein said top panel includes one or more channels selected from the group consisting of one or more channels parallel to the axis, one or more channels transverse to the axis, one or more channels not parallel or transverse to the axis, a combination of one or more channels parallel to the axis and one or more channels transverse to the axis, a combination of one or more channels parallel to the axis and one or more channels not parallel or transverse to the axis, and a combination of one or more channels transverse to the axis and one or more channels not parallel or transverse to the axis.

14. The construction of claim 13 wherein said bottom panel includes one or more channels.

15. The construction of claim 13 wherein said bottom panel includes one or more bottom channels selected from the group of channels parallel to the axis, transverse to the axis, not parallel or transverse to the axis a combination of one or more channels parallel to the axis and one or more channels transverse to the axis, a combination of one or more channels parallel to the axis and one or more channels not parallel or transverse to the axis, and a combination of one or more channels transverse to the axis and one or more channels not parallel or transverse to the axis.

16. The construction of claim 1 wherein the bottom panel includes one or more channels.

17. The construction of claim 1 wherein said bottom panel includes one or more channels selected from the group consisting of one or more channels parallel to the axis, one or more channels transverse to the axis, one or more channels not parallel or transverse to the axis a combination of one or more channels parallel to the axis and one or more channels transverse to the axis, a combination of one or more channels parallel to the axis and one or more channels not parallel or transverse to the axis, and a combination of one or more channels transverse to the axis and one or more channels not parallel or transverse to the axis.

* * * * *